US009742132B1

(12) United States Patent
Hsueh

(10) Patent No.: US 9,742,132 B1
(45) Date of Patent: Aug. 22, 2017

(54) ELECTRICAL CONNECTOR ON CIRCUIT BOARD

(71) Applicant: SPEED TECH CORP., Taoyuan (TW)

(72) Inventor: Cheng-Hsiang Hsueh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/331,907

(22) Filed: Oct. 23, 2016

(30) Foreign Application Priority Data

Jun. 14, 2016 (TW) ..... 105208896 U

(51) Int. Cl.

| | |
|---|---|
| ***H01R 13/648*** | (2006.01) |
| ***H01R 24/60*** | (2011.01) |
| ***H01R 13/516*** | (2006.01) |
| ***H01R 13/6461*** | (2011.01) |
| ***H01R 13/6581*** | (2011.01) |
| ***H01R 12/71*** | (2011.01) |
| *H01R 107/00* | (2006.01) |

(52) U.S. Cl.
CPC ..... *H01R 24/60* (2013.01); *H01R 12/716* (2013.01); *H01R 13/516* (2013.01); *H01R 13/6461* (2013.01); *H01R 13/6581* (2013.01); *H01R 2107/00* (2013.01)

(58) Field of Classification Search
CPC ..... H01R 23/7073; H01R 23/688; H01R 13/65802; H01R 23/6873
USPC ..... 439/79, 108, 607.01, 607.07, 607.08, 439/607.09, 607.35, 607.4, 660
See application file for complete search history.

(56) References Cited

U.S. PATENT DOCUMENTS

| | | | | |
|---|---|---|---|---|
| 6,375,498 | B1 * | 4/2002 | Yu | H01R 12/7029 439/567 |
| 6,676,449 | B2 * | 1/2004 | Ji | H01R 13/65802 439/607.35 |
| 7,108,554 | B2 * | 9/2006 | Huang | H01R 23/6873 439/378 |
| 7,226,314 | B2 | 6/2007 | Lang et al. | |
| 7,331,822 | B2 * | 2/2008 | Chen n | H01R 23/6873 439/607.01 |
| 7,344,409 | B2 * | 3/2008 | Lang | H01R 12/7005 439/372 |
| 7,445,502 | B2 * | 11/2008 | Zhang | H01R 13/6275 439/607.01 |
| 7,445,504 | B1 * | 11/2008 | Zhang | H01R 12/712 439/607.01 |

(Continued)

*Primary Examiner* — Thanh Tam Le
(74) *Attorney, Agent, or Firm* — CKC & Partners Co., LTD.

(57) ABSTRACT

An electrical connector includes an insulating body, plural conductive terminals, and a shielding body. The insulating body includes a top board, a bottom board, and two side boards that form a docking chamber. The top board has a first surface, the bottom board has a second surface facing to the first surface, and plural terminal grooves are formed on the first surface and the second surface. Each of the conductive terminals has a contacting portion and a tail portion connected to the contacting portion. The contacting portion is located in a corresponding one of the terminal grooves, and the tail portion is extended to outside of the insulating body. The shielding body has two side walls opposite to each other and is fixed to an opening of the docking chamber in which two convex portions are respectively located on inner surfaces of the side walls.

8 Claims, 9 Drawing Sheets

(56) References Cited

U.S. PATENT DOCUMENTS

| | | | | |
|---|---|---|---|---|
| 7,997,922 | B2 * | 8/2011 | Dawiedczyk | H01R 13/6275 439/357 |
| 8,109,790 | B2 * | 2/2012 | He | H01R 12/707 439/607.35 |
| 8,202,126 | B2 * | 6/2012 | Lim | H01R 12/707 439/607.31 |
| 8,465,299 | B2 * | 6/2013 | Ho | H01R 13/506 439/607.05 |
| 8,834,206 | B2 * | 9/2014 | Tao | H01R 13/6581 439/607.19 |
| 9,461,378 | B1 * | 10/2016 | Chen | H01R 12/707 |

* cited by examiner

ELECTRICAL CONNECTOR ON CIRCUIT BOARD

CROSS-REFERENCE TO RELATED APPLICATION

This application claims priority to Taiwan Application Serial Number 105208896, filed Jun. 14, 2016, which is herein incorporated by reference.

BACKGROUND

Field of Invention

The present disclosure relates to an electrical connector. More particularly, the present invention relates to an electrical connector with a Serial Attached SCSI (SAS) transmission interface and a shielding body.

Description of Related Art

In recent years, with rapid changes in science and technology, the rapid development of cloud computing comes along with a large amount of data transmission. Hence, connector data transmission has become an indispensable technology. From the early SCSI (Small Computer System Interface) to the current SAS (serial Attached SCSI, serial SCSI), the serial technology for high-speed information access resolves the bottleneck of the traditional parallel technology, and provides faster signal transmission. Furthermore, the SAS devices may support and be compatible with SATA (Serial Advanced Technology Attachment) devices, and has advantages of being applicable with a wide range of devices.

When being docked with a connector, there is no good guiding element between a receptacle and a plug. Therefore, a lot of time is spent in the process of docking the receptacle and the plug with the connector. When having slight angle deviation or dislocation, the plug often cannot be docked with the receptacle smoothly, and even damages the connector structure.

To overcome the problem of plug angle deviation or dislocation when being docked with the connector, U.S. Pat. No. 7,226,314 discloses a receptacle connector A, as shown in FIG. 9. The receptacle connector A has an insulating body B, a circuit board C, and a guiding body D. The insulating body B includes a docking groove (not labeled). The docking groove is disposed on a surface of the insulating body B. Plural terminal grooves (not shown) are disposed on two opposite surfaces of the docking groove. The terminals (not shown) are respectively inserted in the respective terminal grooves of the docking groove of the insulating body B. A welding end (not shown) of each of the terminals extends toward an opening of the docking groove. The insulating body B and the welding ends of the terminals are respectively fixed to the circuit board C. The welding ends are electrically connected to the circuit board C.

The guiding body D is formed from a thin metal plate. The guiding body D includes an upper board D1, two partition plates D2, and a pressing plate D3. The two partition plates D2 respectively extend from opposite sides of the upper board D1, and form a housing space (not labeled). The pressing plate D3 extends from a side of the upper board D1 between the partition plates D2. Two elastic arms D11 extend from a connecting side of the upper board D1 and the pressing plate D3. The elastic arms D11 are disposed at two opposite sides of the pressing plate D3. The elastic arms D11 bend toward the housing space. The elastic arms D11 resist and contact two bending portions D12 extending from a frond end of the upper board D1. A notch D21 is disposed on a side of each of the partition plates D2, in which the side is opposite to the pressing plate D3 and near an opening of the housing space. Plural fixing ends extend form each of the partition plates D2 (not shown). The guiding body D is fixed to the circuit board C by using the fixing ends and is disposed at a front end of the docking groove of the insulating body B. The pressing plate D3 extends above the insulating body B. Then, the receptacle connector A is formed by assembling the insulating body B, the circuit board C, and the guiding body D.

In the aforementioned technique, the guiding body D is fixed to the front end of the opening of the docking groove of the insulating body B. When the receptacle connector A is docked with a plug connector (not shown), the plug connector is guided by the elastic arms D11. The elastic arms D11 provide a rapid positioning for a vertical position from upper and bottom portions, thereby enabling a tongue plate of the plug connector to be accurately inserted in the docking groove, and enabling the plug connector to be received in the housing space of the guiding body D, thus reducing the assembly time caused by lacking of the accurately positioning between the receptacle connector A and the plug connector. The guiding body D is made of metal material, which enables the receptacle connector A to have a good shielding effect. By using the guiding body D covering the plug connector during high frequency signal transmission, the receptacle connector A has a function of shielding external electromagnetic interference, and grounding internal noise through the fixing ends, thus increasing the yield of signal transmission.

However, in the aforementioned skill, when being docked with the receptacle connector A, the tongue plate of the plug connector can provide vertical positioning from upper and bottom portions but fails to provide horizontal positioning. Thus, when the plug connector is docked with the receptacle connector A, horizontal positioning is not accurate, thus causing the tongue plate to be deviated horizontally. Because the tongue plate is not in the right position, the tongue plate may scratch the insulating body B of the receptacle connector A, and damage the insulating body B, thus reducing the service life of the receptacle connector A.

Since the prior art cannot provide a method to prevent the insulating body of the receptacle connector from being scratched so as to meet industrial actual requirements, the present disclosure provides improved technical solutions to overcome the problems.

SUMMARY

The present disclosure provides an electrical connector includes a shielding body. When the electrical connector is docked with a docking connector, the shielding body can guide the electrical connector to be docked with the docking connector accurately, thereby preventing the insulating body of the electrical connector from being scratched by the docking connector, thus prolonging the service life of the electrical connector.

The present disclosure provides an electrical connector includes a shielding body. When the electrical connector is docked with a docking connector with high frequency signal transmission, the shielding body is able to provide a better shielding effect to the docking connector, so as to reduce interferences of external electromagnetic wave and noise, thus enhancing the yield of signal transmission.

The present disclosure provides an electrical connector includes an insulating body, plural conductive terminals, a grounding member, an engaging member, and a shielding body. The insulating body has a docking chamber. The insulating body includes a top board, a bottom board, and two side boards that form the docking chamber. The top board has a first surface, the bottom board has a second surface facing to the first surface, and plural terminal grooves are formed on the first surface and the second surface. Plural outer surfaces of the opposite two side boards of the insulating body respectively include protruding portions. Each of the conductive terminals has a contacting portion and a tail portion connected to the contacting portion, and a body portion. The body portion is connected to the contacting portion and the tail portion. The contacting portion is located in a corresponding one of the terminal grooves, and the conductive terminals are arranged in two opposite rows, and the tail portion is extended to outside of the insulating body. The grounding member is formed from a thin metal plate and has plural elastic arms. The grounding member is assembled on the engaging member. The grounding member and the engaging member are assembled between two opposite rows of the conductive terminals. The elastic arms of the grounding member respectively contact plural grounding terminals of the conductive terminals. A housing space is formed by four side walls of the shielding body and has two ear clips and two convex portions. The two ear clips extend from two opposite side surfaces. The shielding body is fixed in the docking chamber of the insulating body. Each of the ear clips interferes with a corresponding one of the protruding portions of the insulating body. The shielding body is fixed in the insulating body. The shielding body has two side walls opposite to each other. The shielding body has plural fixing ends extending outward, and is fixed in an opening of the docking chamber. Two convex portions are respectively disposed on inner surfaces of the side walls of the shielding body and are located on the shielding body and near the ear clips, and each of the convex portions protrude to cover a portion of a surface of a corresponding one of the side walls adjacent to the opening. The housing space of the shielding body is located near the opening of the docking chamber.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
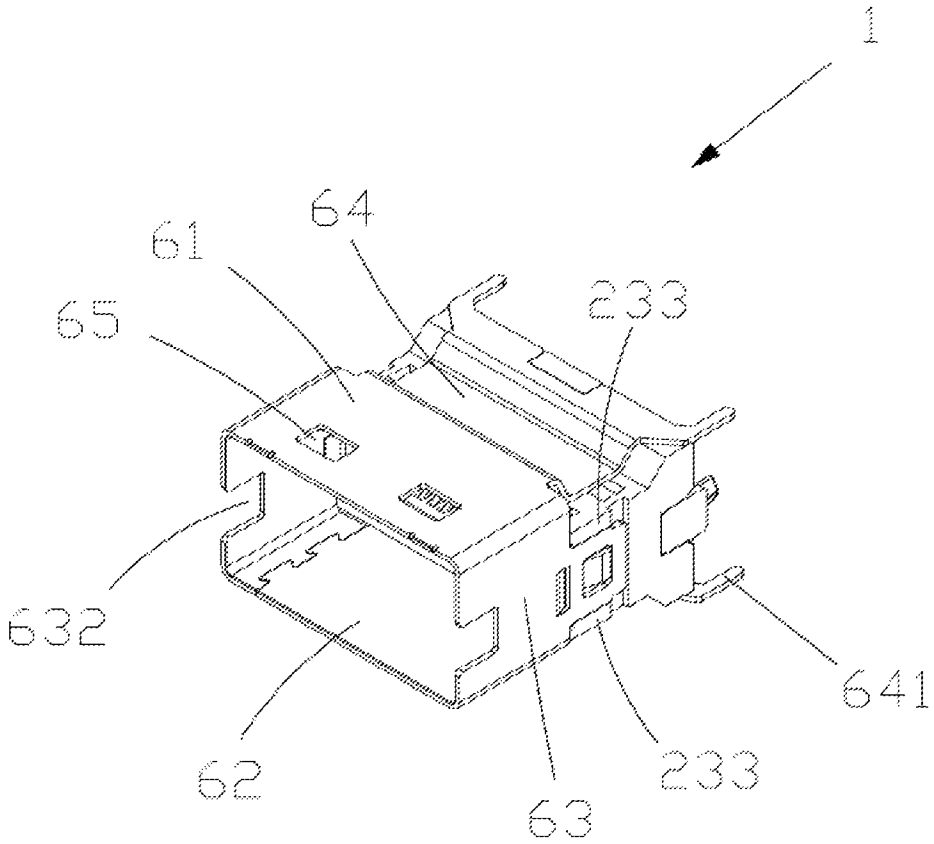
FIG. 1 is a schematic perspective view of an electrical connector in accordance with some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

Figure 2:
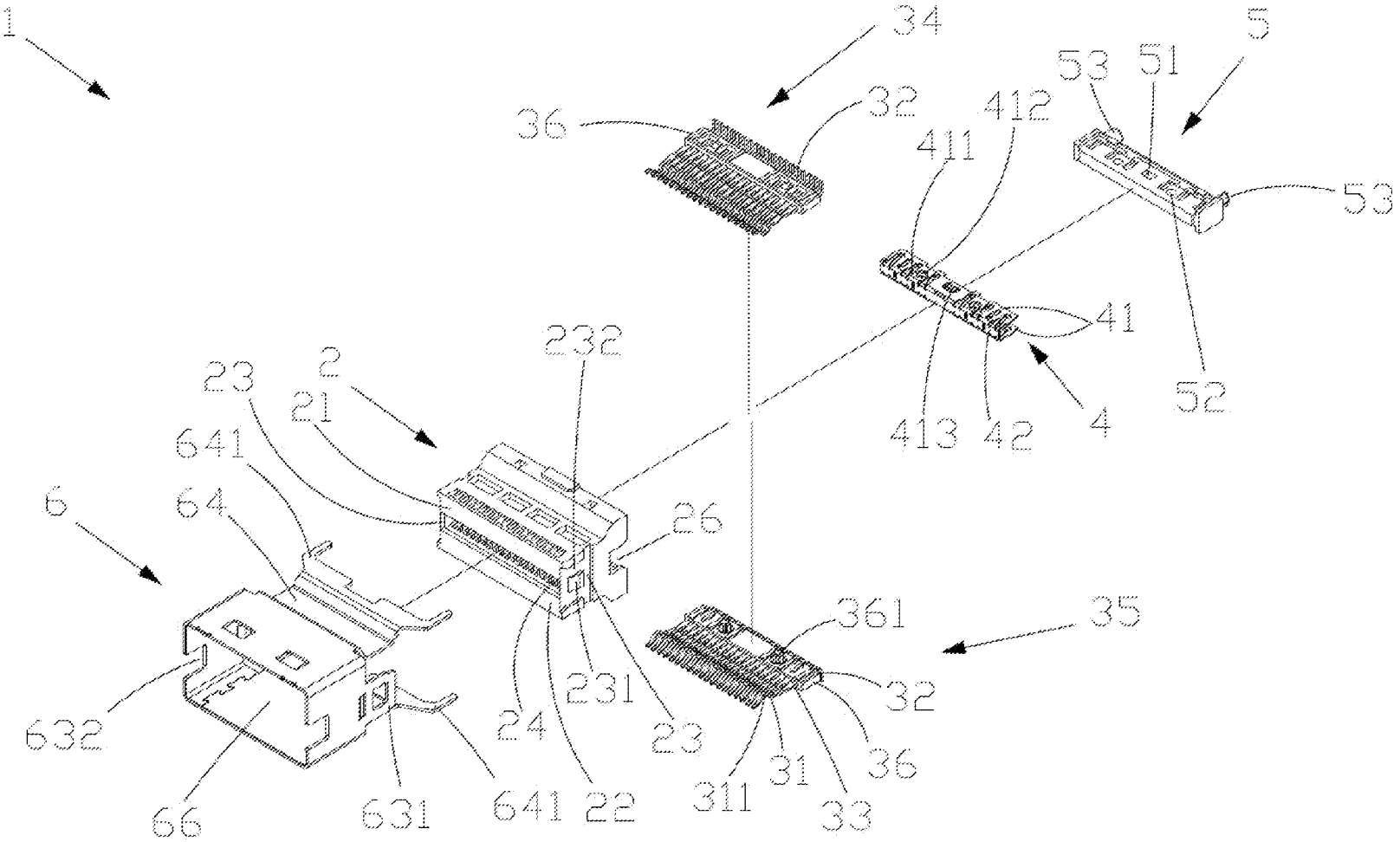
FIG. 2 is a schematic exploded view of the electrical connector in accordance with some embodiments of the present disclosure.

As shown in FIG. 1 and FIG. 2, the present disclosure provides an electrical connector 1 for high frequency signal transmission. The electrical connector 1 includes an insulating body 2, conductive terminals 3, a grounding member 4, an engaging member 5, and a shielding body 6. The electrical connector 1 may be fixed on a circuit board (not shown), and may be inserted into a docking connector 7.

Figure 3:
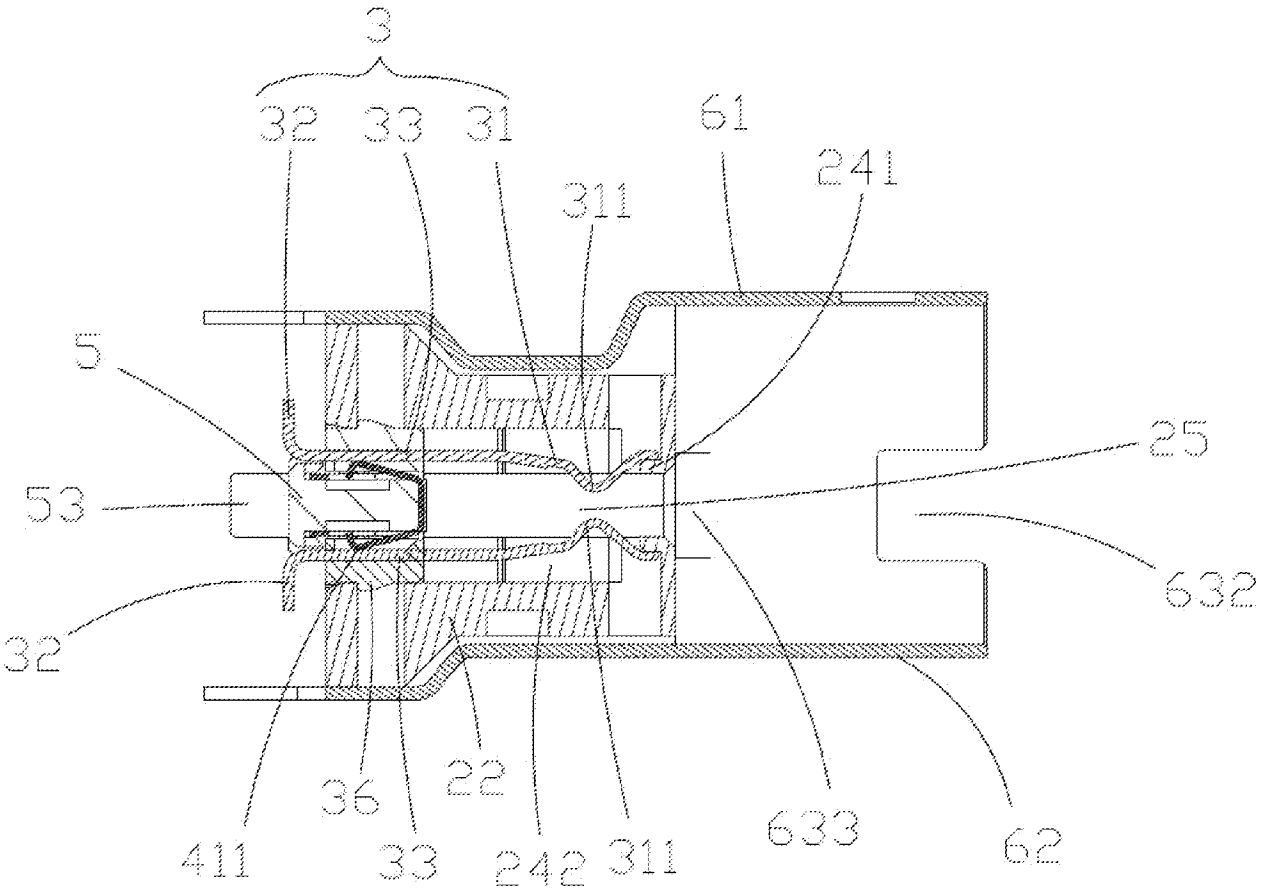
FIG. 3 is a cross sectional side view of the electrical connector in accordance with some embodiments of the present disclosure.

In some embodiments of the present disclosure, reference is made to FIG. 2 and FIG. 3. The insulating body 2 is made of insulating material. A docking chamber 25 is disposed on the insulating body 2, and passes through the insulating body 2. The docking chamber 25 is a space formed and surrounded by a top board 21, a bottom board 22, and two side boards 23. The two side boards 23 are opposite to each other. The top board 21 has a first inner surface, and the bottom board 22 has a second inner surface facing to the first inner surface. The partition walls 24 are formed on the inner surfaces, and a terminal groove 242 is formed between adjacent two of the partition walls 24. Therefore, the terminal grooves 242 are formed on the inner surfaces by the partition walls 24. Bearing plates 241 are disposed near to an opening of the docking chamber 25, and are respectively connected to the adjacent partition walls 24. The bearing plates 241 are paralleled to the top board 21 and the bottom board 22.

Plural outer surfaces of the opposite two side boards 23 near the opening of the docking 25 respectively include a protruding portion 231 and a guiding channel 232. The protruding portion 231 and the guiding channel 232 are designed to be engaged with another element. The surfaces of the opposite two side boards 23 near the opening of the docking 25 respectively include two protruding portions 233. The two protruding portions 233 are spaced from each other at a distance. A recess located within the distance is the guiding channel 232. The insulating body 2 has a rear opening (not shown) opposite to the opening of the docking chamber 25. The rear opening communicates with the opening of the docking chamber 25. Plural notches 26 are respectively disposed on the two side boards 23 near the rear opening. The notches 26 may be used to fix the engaging member 5.

In some embodiments of the present disclosure, reference is made to FIG. 2 and FIG. 3. The conductive terminals 3 include signal terminals (not shown) and grounding terminals (not shown). The signal terminals and the grounding terminals have the same structures and shapes. Because a distance between adjacent two of the conductive terminals 3 is small, the distances between every two adjacent conductive terminals 3 are not the same in general assembly. Hence, the present disclosure herein uses the insert molding to form the conductive terminals 3. The conductive terminals 3 are respectively molded in the insulating carriers 36. The insert molding can accurately control the distance between two adjacent conductive terminals 3. The insulating carriers 36 can expose the grounding terminals for connecting to the grounding member 4. Plural columns 361 are disposed on the insulating carriers 36.

Each of the conductive terminals 3 includes a contacting portion 31, a tail portion 32, and a body portion 33. The body portion 33 is connected to the contacting portion 31 and the tail portion 32. The contacting portion 31 has a bending portion 311 and is disposed in the terminal groove 242 of the insulating body 2. The bending portion 311 extends from the terminal groove 242 to outside of the docking chamber 25. The front end of the bending portion 311 resists against corresponding one of the bearing plates 241 and exerts a force on the bearing plate 241. Because a position of the bending portion 311 is limited by the bearing plate 241, the bending portion 311 may generate an elastic deformation toward a direction opposite to the bearing plate 241, such that the contacting portion 31 bears a pre-load providing by the bearing plate 241 before the contacting portion 31 is inserted into the docking connector 7. When the electrical connector 1 is inserted to the docking connector 7, the contacting portion 31 of the conductive terminal 3 can exert a larger positive force on the docking connector 7, thereby enabling transmissions through the conductive terminals 3 to be more stable.

In some embodiments of the present disclosure, the grounding member 4 is formed from a thin metal plate and is bent into three sections. The three sections include two grounding surfaces 41 and one connecting surface 42. The two grounding surfaces 41 are opposite and parallel to each other. The connecting surface 42 connects the two grounding surfaces 41. The grounding surface 41 has elastic arms 411, holes 412, and fastening members 413. The elastic arms 411 of the grounding surface 41 respectively have warpages toward the other grounding surface 41 and connect the connecting surface 42. The elastic arms 411, the holes 412, and the fastening members 413 may be formed by punching, cutting, and bending, for example.

In some embodiments of the present disclosure, the engaging member 5 is an insulating body formed from insulating material. The shape of the engaging member 5 is like a rectangular column of hexahedral. Plural recess holes 51 and plural recess portions 52 are disposed on two of the parallel surfaces of the engaging member 5. The engaging member 5 is embedded between the two grounding surfaces 41 of the grounding member 4. The fastening members 413 of the grounding member 4 are respectively fixed in the recess holes 51. The recess portions 52 of the engaging member 5 have the same profiles as the holes 412 of the grounding member 4. The holes 412 of the grounding member 4 are respectively corresponding to the recess portions 52 of the engaging member 5. Plural fixing columns 53 extend from a surface of the engaging member 5, in which the surface is opposite to another surface of engaging member 5 contacting the connecting surface 42 of the grounding member 4.

In some embodiments of the present disclosure, the conductive terminals 3 are fixed in the two insulating carrier 36 by injection molding, thereby forming an upper terminal assembly 34 and a lower terminal assembly 35. The engaging member 5 is fixed to the grounding member 4. Each of the recess portions 52 of the engaging member 5 matches with corresponding one of the holes 412 of the grounding member 4. The columns 361 of the insulating carriers 36 of the upper terminal assembly 34 and the lower terminal assembly 35 are respectively fixed to the recess portions 52 and the holes 412 of the engaging member 5 and the grounding member 4. The engaging member 5 and the grounding member 4 are clamped between the upper terminal assembly 34 and the lower terminal assembly 35. The elastic arms 411 of the grounding member 4 are respectively elastically connected to the grounding terminals exposed from the insulating carriers 36, thereby effectively grounding noises during high frequency transmission through the grounding member 4 to reduce the electromagnetic interferences and to enhance the transmission efficiency.

A terminal module (not shown) is formed by assembling the upper terminal assembly 34, the lower terminal assembly 35, the engaging member 5, and the grounding member 4 with a simple assembly concept. The terminal module can be inserted into and assembled from the rear opening of the insulating body 2 toward the opening of the docking chamber 25. Each of the contacting portions 31 of the conductive terminals 3 is disposed in the corresponding one of the terminal grooves 242. The tail portions 32 extend to outside of the insulating body 2. Two ends of the engaging member 5 can be respectively assembled at the notches 26 of the two side boards 23, thereby fixing the terminal module to the insulating body 2. This assembly method can simplify the manufacturing process and improve production efficiency. The electrical connector 1 can be fixed on the circuit board by the fixing columns 53 of the engaging member 5. The tail portions 32 of the conductively terminals 3 are welded on the circuit board. The welding method may use a surface mount technology (SMT). A docking direction of the electrical connector 1 which is referred to as a straight type connector may be perpendicular to a surface of the circuit board. However, the types of connectors are not limited to the aforementioned connector. The connectors may use be mounted on the circuit board through any angle and position. For example, a docking direction of the electrical connector which is referred to as a right angle type may be parallel to the surface of the circuit board. Alternatively, the electrical connectors can be mounted on the circuit board by a sink type design.

Figure 4:
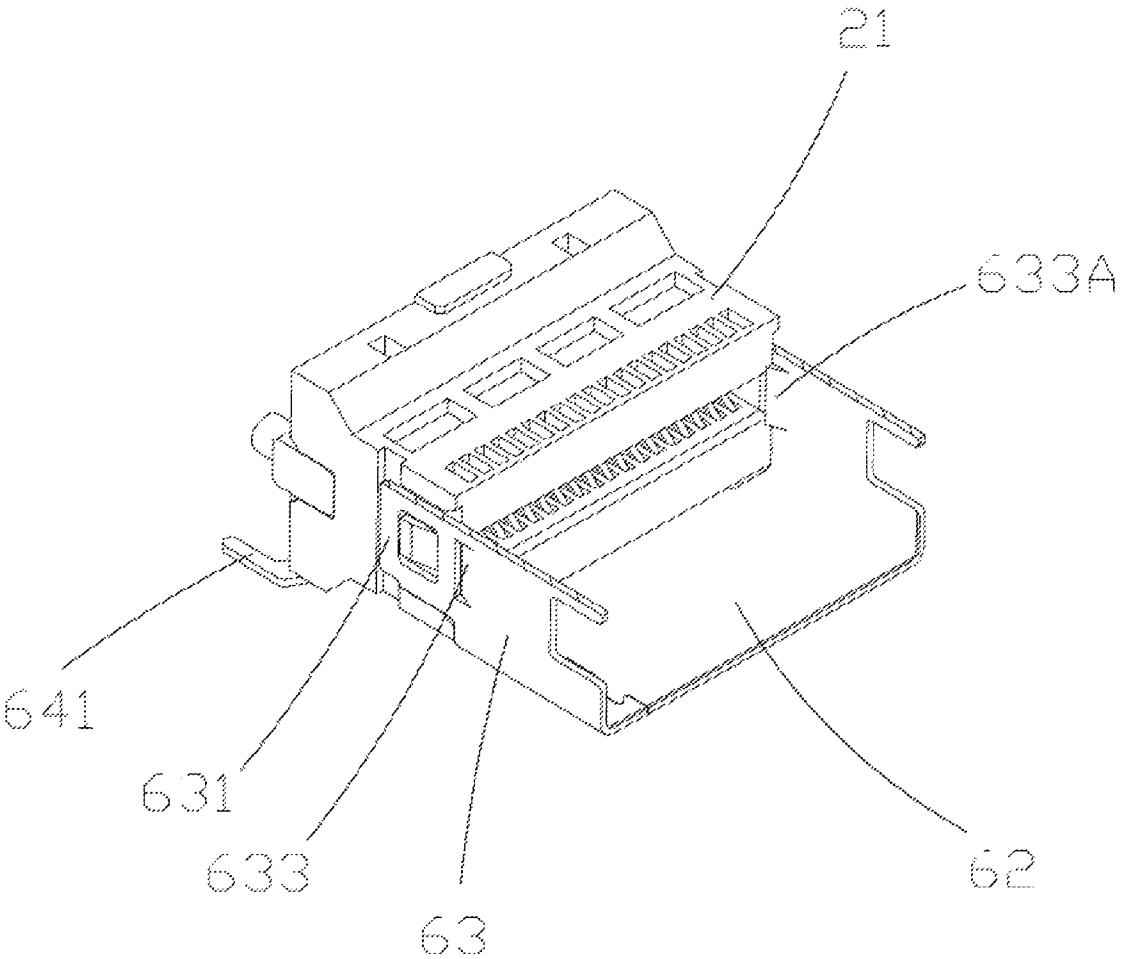
FIG. 4 is a partial view of components of the electrical connector in accordance with some embodiments of the present disclosure.
Figure 5:
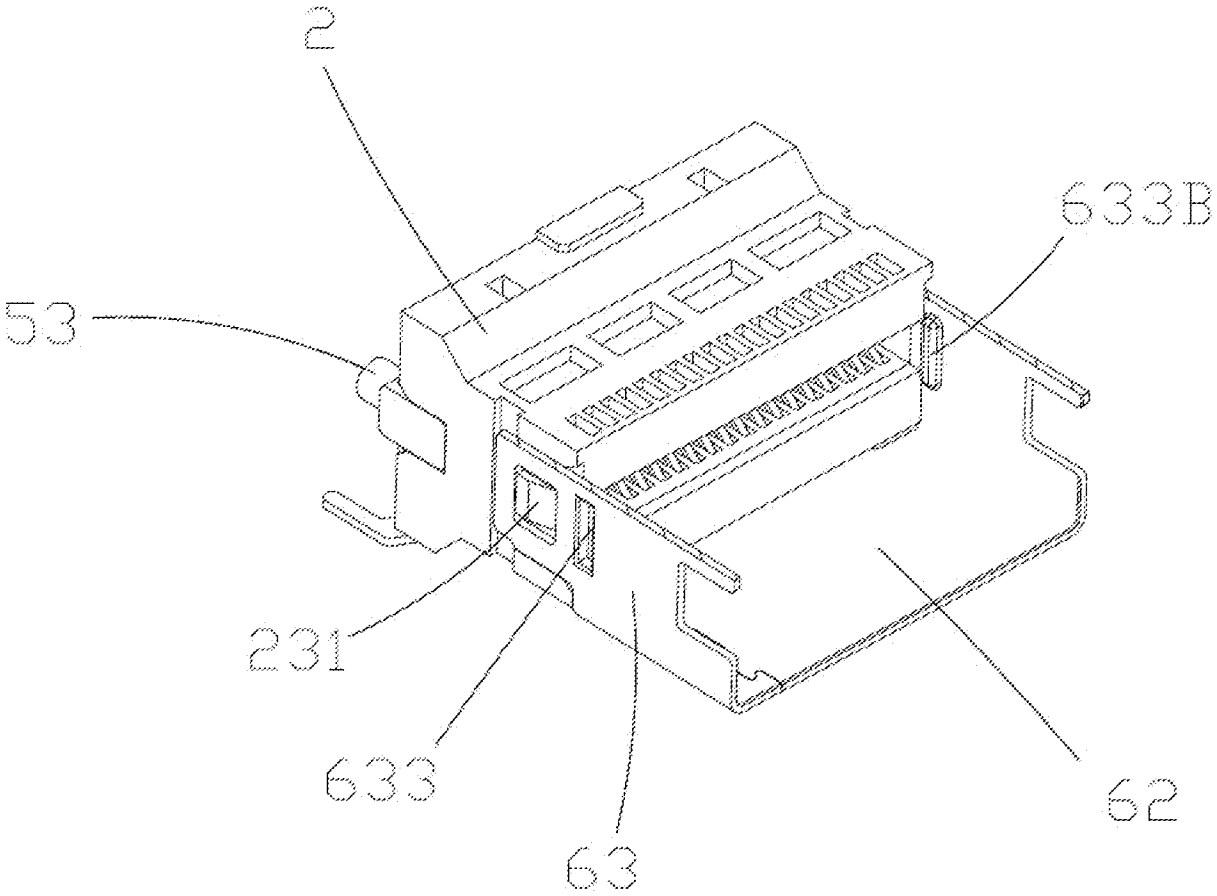
FIG. 5 is a partial view of components of the electrical connector in accordance with some embodiments of the present disclosure.

In some embodiments of the present disclosure, reference is made to FIG. 4 and FIG. 5. The shielding body 6 is formed from a thin metal plate. The shielding body 6 includes a top wall 61, a bottom wall 62, and two side walls 63. A housing space 66 is formed by the top wall 61, the bottom wall 62, and the two side walls 63. Plural extending portions 64 respectively extend from the top wall 61 and the bottom wall 62. Plural openings 65 are disposed on one of the top wall 61 and the bottom wall 62. The openings 65 may be used to fix the docking connector 7. The extending portions 64 have fixing ends 641. Each ear clip 631 of the side walls 63 extends to a direction along which the extending portion 64 extends. A rectangular notch 632 is disposed at a side of each of the side walls 63, and the side is opposite to another side having the ear clip 631 thereon. The notches 632 may ensure the reliability of docking between the electrical connector 1 and the docking connector 7. A convex portion 633 is disposed on an inner surface of each of the side walls 63. The convex portion 633 is adjacent to the corresponding ear clip 631 of the side wall 63 at which the convex portion 633 is disposed. The convex portion 633 may be made by punching, cutting, and bending, for example, so as to form a pair of elastic inclined planes 633A, a pair of arc convex portions 633B, or a pair of U-shaped elastic structure (not shown), for example.

In some embodiments of the present disclosure, the ear clips 631 of the shielding body 6 are respectively inserted into the guiding channels 232 of the insulating body 2, and are respectively engaged with the protruding portions 231 on the outer surfaces of the side boards 23 of the insulating body 2, such that the shielding body 6 is fixed in the docking chamber 25 of the insulating body 2. Furthermore, the fixing method is not limited to using the ear clips 631. The fixing method may also use the injection fixing method to fix the shielding body 6 in the docking chamber 25. The convex portions 633 of the side walls 63 of the shielding body 6 may respectively protrude to cover a portion of the surfaces of the side boards 23, in which the surfaces are located near the opening of the docking chamber 25. The convex portions 633 may prevent the insulating body 2 from being scratched during docking with the docking connector 7. The extending portion 64 of the top wall 61 of the shielding body 6 covers and fits to the outer surface of the top board 21 of the insulating body 2. The extending portion 64 of the bottom wall 62 of the shielding body 6 covers and fits to the outer surface of the bottom board 22 of the insulating body 2. The fixing ends 641 of the extending portion 64 extend to outside of the insulating body 2. The fixing ends 641 of the shielding body 6 may be welded on the circuit board to ground the shielding body 6, thereby providing a better electromagnetic shielding effect.

Reference is made to FIG. 4. The convex portion 633 includes a convex structure of an elastic inclined plane 633A. The elastic inclined plane 633A is disposed on an inner surface of each of the side walls 63. The elastic inclined plane 633A is adjacent to the corresponding ear clip 631 of the side wall 63 at which the elastic inclined plane 633A is disposed. The elastic inclined planes 633A are rectangular structures. The elastic inclined plane 633A is connected to corresponding one of the side walls 63 through its one side, and the remaining three sides of the elastic inclined plane 633A may be separated from the corresponding one of the side walls 63 by the method of punching or cutting. The elastic inclined planes 633A bend toward the housing space 66, and each forms an acute angle with a corresponding one of the side walls 63. The elastic inclined planes 633A may respectively protrude to cover a portion of the surfaces of the side boards 23, in which the surfaces are located near the opening of the docking chamber 25. The elastic inclined planes 633A may guide the docking connector 7 to be docked with the electronic connector 1, and effectively prevent the insulating body 2 from being scratched during docking with the docking connector 7.

Reference is made to FIG. 5. The convex portion 633 includes a convex structure of an arc convex portion 633B. The arc convex portion 633B is formed on each of the side walls 63 by punching or injection molding. The arc convex portion 633B is adjacent to the corresponding ear clip 631 of the side wall 63 at which the arc convex portion 633B is disposed. The arc convex portions 633B protrude toward each other and protrude to cover a portion of the surfaces of the side boards 23, in which the surfaces are located near the opening of the docking chamber 25. Because having no convex inclined plane, the arc convex portions 633B may guide the docking connector 7 to be docked with the electronic connector 1, and prevent the insulating body 2 from being scratched during docking with the docking connector 7.

The convex portion 633 also may include a U-shaped elastic structure (not shown). The U-shaped elastic structure is disposed on an inner surface of each of the side walls 63. The U-shaped elastic structure is adjacent to the corresponding ear clip 631 of the side wall 63 at which the U-shaped elastic structure is disposed. The U-shaped elastic structure is rectangular and is connected to a corresponding one of the side walls 63 through its one side, and the remaining three sides of the U-shaped elastic structure may be separated from the corresponding one of the side walls 63 by punching or cutting, so as to manufacture a U-shaped structure. The U-shaped elastic structure may respectively protrude to cover a portion of the surfaces of the side boards 23, in which the surfaces are located near the opening of the docking chamber 25. The U-shaped elastic structures may guide the docking connector 7 to be docked with the electronic connector 1, and effectively prevent the insulating body 2 from being scratched during docking with the docking connector 7.

Figure 6:
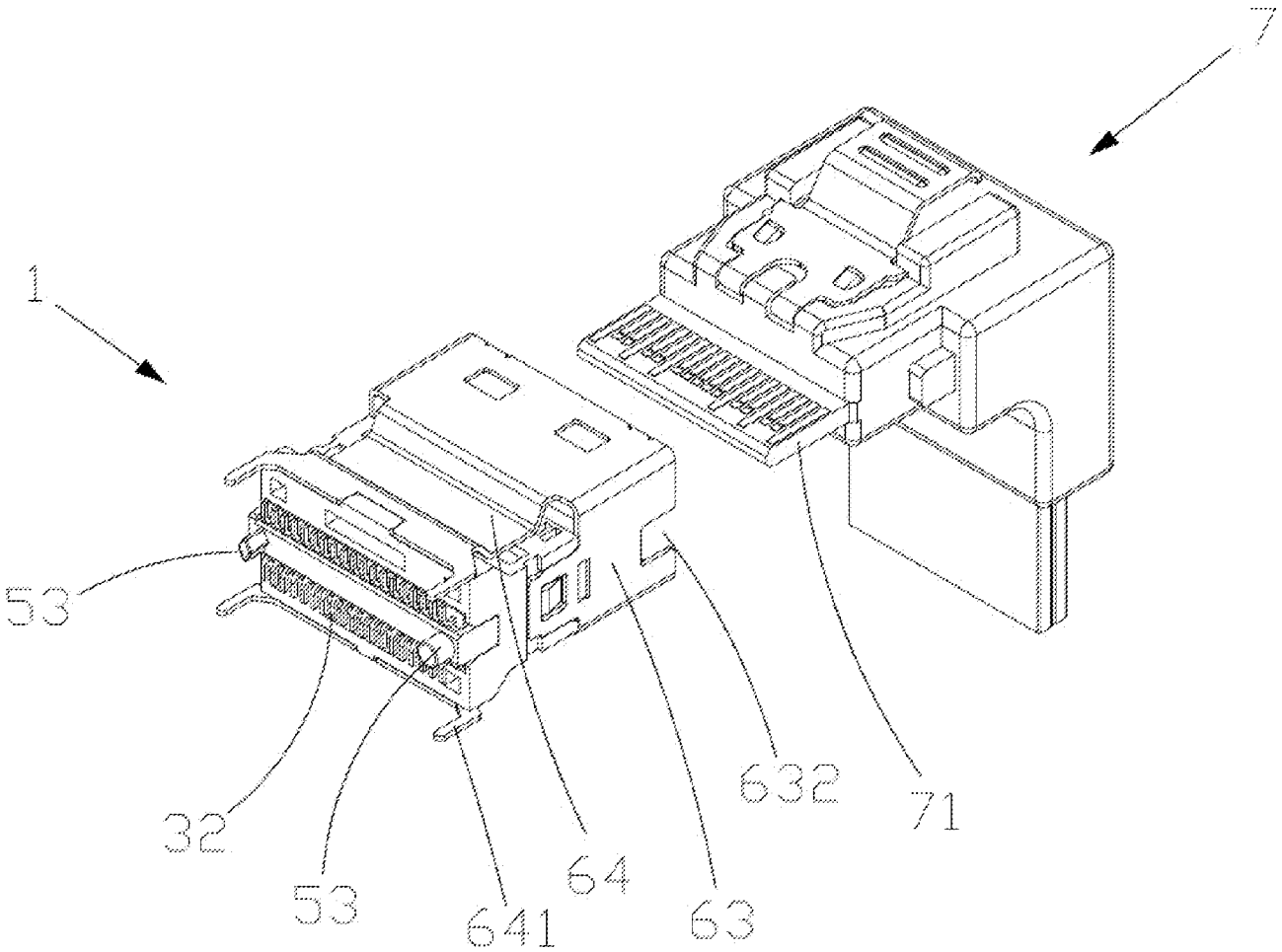
FIG. 6 is a schematic perspective view of the electrical connector and a docking connector in accordance with some embodiments of the present disclosure.
Figure 7:
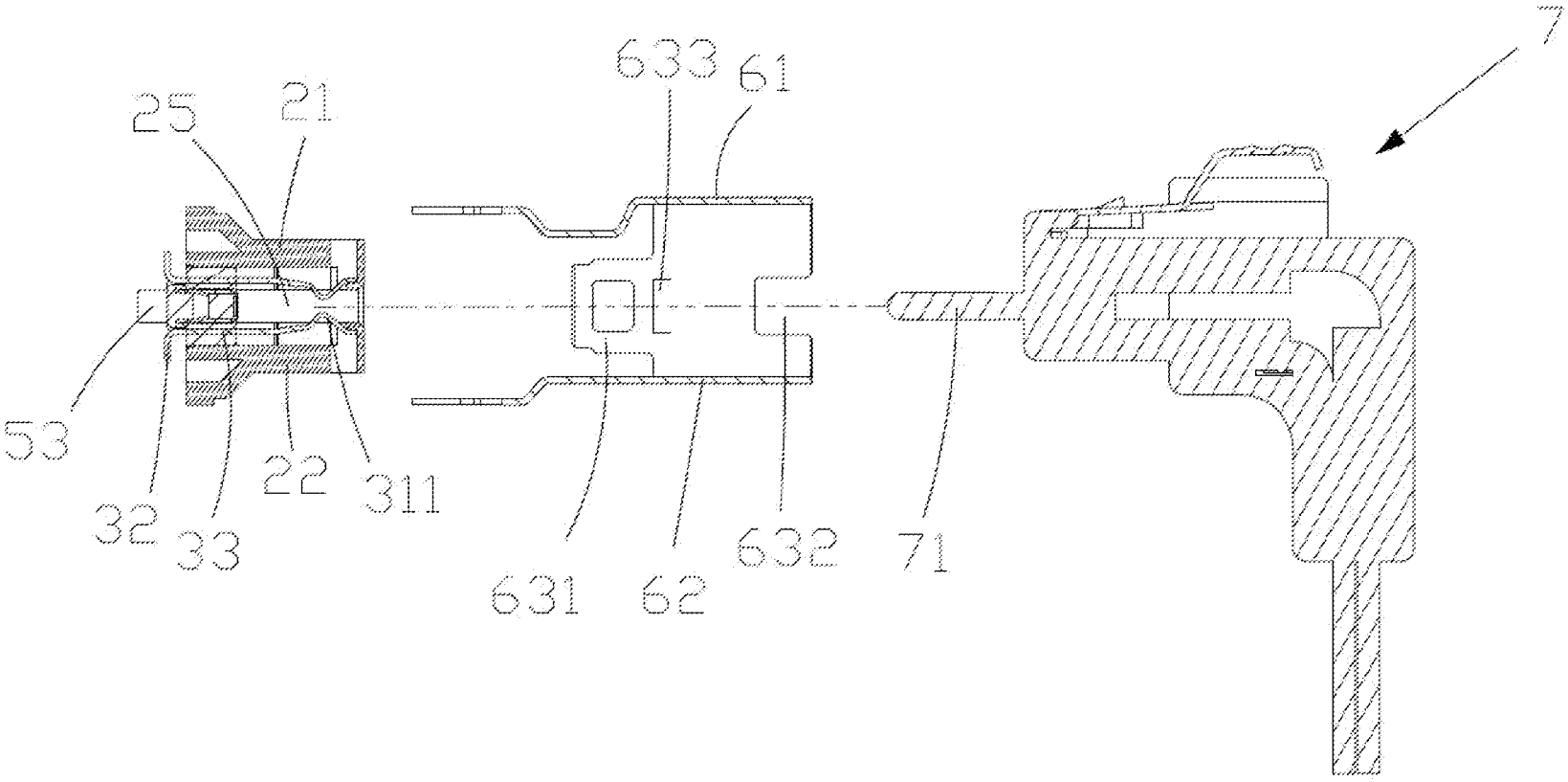
FIG. 7 is a schematic cross sectional side view of the electrical connector and the docking connector in accordance with some embodiments of the present disclosure.
Figure 8:
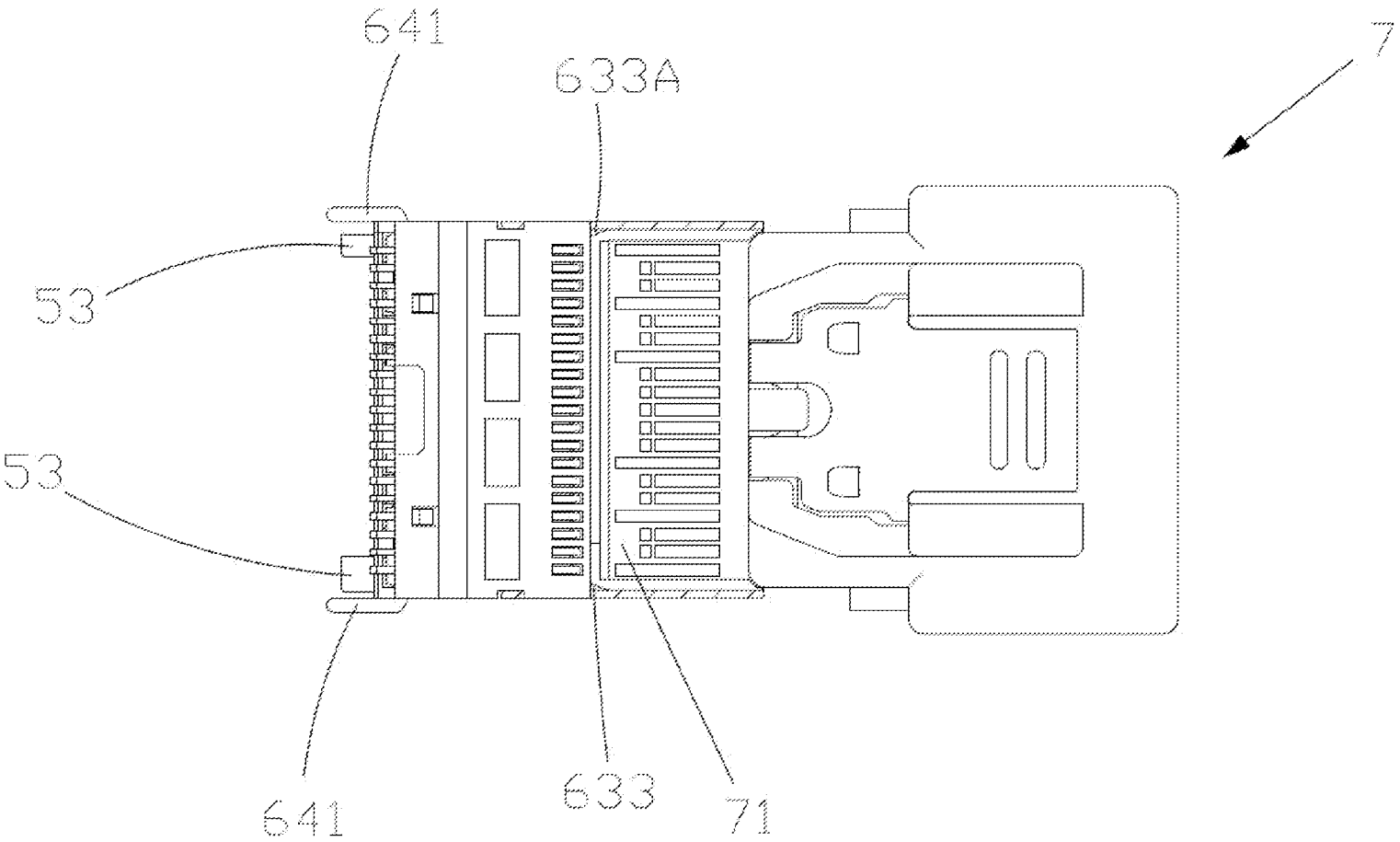
FIG. 8 is a schematic partial cross sectional top view of the electrical connector and the docking connector in accordance with some embodiments of the present disclosure.
Figure 9:
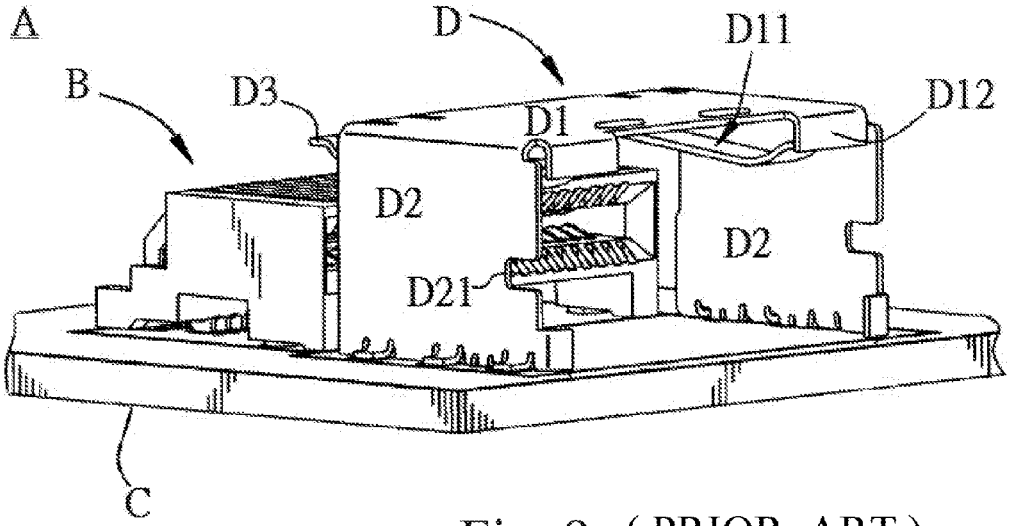
Fig. 9 (PRIOR ART)
FIG. 9 is a schematic perspective view of an electrical connector in accordance with the prior art of U.S. Pat. No. 7,226,314.

In some embodiments of the present disclosure, reference is made to FIGS. 6, 7, and 8. The docking connector 7 has a tongue plate 71. The tongue plate 71 is docked with the electronic connector 1. When the tongue plate 71 is inserted into the housing space 66 formed by the shielding body 6, the convex portions 633 of the shielding body 6 guides the tongue plate 71. Then, the tongue plate 71 is successfully inserted into the docking chamber 25 of the insulating body 2 by the inclined plane or curvature surface of the convex portion 633. The convex portions 633 can guide the docking connector 7 to be docked with the electronic connector 1, and further protect the insulating body 2. Because the side boards 23 of the insulating body 2 do not have the conductive terminals 3 disposed on the top board 21 and the bottom board 22 for docking and avoid being scratched, the convex portions 633 may protect the side boards 23. The convex portions 633 are respectively disposed on and protrude to cover a portion of the surfaces of the side boards 23, and the surfaces are located near the opening of the docking chamber 25 of the insulating body 2. The convex portions 633 may effectively prevent plug angle deviation or plug dislocation during the docking of the tongue plate 71, thereby preventing the insulating body 2 from breaking, thus enhancing the service life of the electronic connector 1.

The shielding body 6 provides a better electromagnetic shielding effect. The shielding body 6 is made of metal material and may prevent the electromagnetic interferences. The shielding body 6 has the housing space 66 to receiver the docking connector. The pair of extending portions 64 extend from the shielding body 6 to cover the terminal grooves 24 of the insulating body 2. The extending portions 64 have the fixing ends 641 electrically connected to the circuit board to provide the grounding function. The shielding body 6 can prevent external electromagnetic interferences, and ground internal noise during high frequency signal transmission, and thus provide good signal transmission yield.

Compared with the prior art, in some embodiments of the present disclosure, the convex portions 633 of the shielding body 6 are disposed on and protrude to cover a portion of the surfaces of the side boards 23, and the surfaces are located near the opening of the docking chamber 25 of the insulating body 2. The surfaces of the convex portions 633 provide a guiding function so as to effectively prevent the insulating body 2 from being scratched by the tongue plate 71 of the docking connector 7. The surfaces of the convex portions 633 guide the tongue plate 71 into the docking chamber 25 of the insulating body 2 to reduce the number of docking mistakes caused by the alignment between the tongue plate 71 and the docking chamber 25, and to reduce the time for performing the docking process, thereby preventing the insulating body 2 from being scratched by the docking connector 7 due to the docking mistakes, thus prolonging the service life of the electrical connector 1 to meet the demands of the users.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An electrical connector, comprising:

an insulating body comprising a top board, a bottom board, and two side boards that form a docking chamber, wherein the top board has a first surface, the bottom board has a second surface facing to the first surface, a plurality of terminal grooves are formed on the first surface and the second surface, and the docking chamber has an opening;

a plurality of conductive terminals each having a contacting portion and a tail portion connected to the contacting portion, the contacting portion being disposed in a corresponding one of the terminal grooves, the tail portion being extended to outside of the insulating body;

a shielding body having two side walls opposite to each other, having a plurality of fixing ends extending outward, and being fixed to a portion of the insulating body adjacent to the opening; and two convex portions respectively located on inner surfaces of the side walls, and each of the convex portions protruding to cover a portion of a surface of a corresponding one of the side boards adjacent to the opening.

2. The electrical connector of claim 1, wherein each of the convex portions is an elastic inclined plane punched from the shielding body.

3. The electrical connector of claim 1, wherein each of the convex portions is an arc convex portion.

4. The electrical connector of claim 1, wherein the insulating body comprises a plurality of bearing plates and a plurality of partition walls, any adjacent two of the partition walls form a corresponding one of the terminal grooves, and each of the bearing plates is disposed between and connected to adjacent two of the partition walls for receiving a pre-loaded force applied by a corresponding one of the conductive terminals.

5. The electrical connector of claim 1, wherein the shielding body has a top wall and a bottom wall connected to the side walls, the top wall and the bottom wall are respectively connected to corresponding ones of the fixing ends through two extending portions, the extending portions respectively cover the top board and the bottom board, and the fixing ends are extended form the opening to outside of the insulating body.

6. The electrical connector of claim 1, wherein the tail portions of the conductive terminals and the fixing ends of the shielding body are electrically connected to a circuit board.

7. The electrical connector of claim 1, further comprising a grounding member, the conductive terminals comprising a plurality of signal terminals and a plurality of grounding terminals, wherein the grounding member comprises a plurality of elastic arms, and the grounding terminals contact the elastic arms respectively.

8. The electrical connector of claim 1, wherein two protruding portion are respectively formed on outer walls of the side boards, the shielding body has a plurality of ear clips thereon, and each of the ear clips interferes with a corresponding one of the protruding portions.

* * * * *